US008332973B2

(12) United States Patent
Davis

(10) Patent No.: US 8,332,973 B2
(45) Date of Patent: Dec. 18, 2012

(54) BED TO A SOFA CONVERSION FRAME

(75) Inventor: Clark M. Davis, Lewiston, ME (US)

(73) Assignee: Bed To A Sofa Conversion Company, LLC, Vienna, VA (US)

( * ) Notice: Subject to any disclaimer, the term of this patent is extended or adjusted under 35 U.S.C. 154(b) by 6 days.

(21) Appl. No.: 13/039,735

(22) Filed: Mar. 3, 2011

(65) Prior Publication Data

US 2011/0214232 A1 Sep. 8, 2011

Related U.S. Application Data

(60) Provisional application No. 61/282,585, filed on Mar. 3, 2010.

(51) Int. Cl.
*A47C 17/02* (2006.01)

(52) U.S. Cl. ..... 5/37.1; 5/12.1; 5/200.1

(58) Field of Classification Search ..... 5/200.1, 5/12.1, 37.1, 53.3, 659
See application file for complete search history.

(56) References Cited

U.S. PATENT DOCUMENTS

| | | | | | |
|---|---|---|---|---|---|
| 316,901 | A | * | 4/1885 | Kreith | 5/43 |
| 571,000 | A | * | 11/1896 | Jackson | 297/117 |
| D73,825 | S | * | 11/1927 | Braus | D6/336 |
| 2,466,204 | A | * | 4/1949 | Brown | 297/115 |
| 2,517,037 | A | * | 8/1950 | Shaw | 297/117 |
| 2,570,401 | A | * | 10/1951 | Stein | 5/12.1 |
| 2,579,921 | A | | 12/1951 | Gibbs | |
| 2,694,207 | A | | 11/1954 | MacEachron | |
| 2,834,029 | A | * | 5/1958 | Frampton et al. | 5/47 |
| 2,909,789 | A | * | 10/1959 | Bailey | 5/8 |
| 3,222,691 | A | | 12/1965 | Osborne | |
| 3,258,787 | A | * | 7/1966 | Emmons et al. | 5/43 |
| 3,654,642 | A | | 4/1972 | Barabas | |
| 3,929,375 | A | * | 12/1975 | Gans | 297/440.23 |
| 4,204,287 | A | | 5/1980 | Lane et al. | |
| 4,364,134 | A | * | 12/1982 | Marks | 5/201 |
| 4,481,684 | A | | 11/1984 | Hauck | |
| 4,571,756 | A | | 2/1986 | Castro et al. | |
| 4,586,206 | A | | 5/1986 | Singer | |
| 4,592,101 | A | * | 6/1986 | Page | 5/9.1 |
| 4,651,363 | A | * | 3/1987 | Mizelle | 5/37.1 |

(Continued)

FOREIGN PATENT DOCUMENTS

| | | |
|---|---|---|
| DE | 298 20 325 | 3/1999 |

(Continued)

OTHER PUBLICATIONS

International Search Report and Written Opinion of the International Searching Authority, dated Jun. 27, 2011, from corresponding application No. PCT/US2011/000412.

*Primary Examiner* — Michael Trettel
*Assistant Examiner* — Myles Throop
(74) *Attorney, Agent, or Firm* — Buchanan Ingersoll & Rooney

(57) ABSTRACT

A bed to a sofa conversion frame includes a backrest, a footer (optional) and a pair of armrests adapted to be solid state or assembled together to form a sofa frame around a traditional bed and it base frame. The pair of armrests forms a base for mounting the backrest and the footer via corresponding mounting hardware and mounting slots. Both the backrest and the footer may be a solid state unit or an assembly and/or foldable to provide easy storage.

18 Claims, 5 Drawing Sheets

U.S. PATENT DOCUMENTS

| | | | | |
|---|---|---|---|---|
| 4,669,135 | A * | 6/1987 | Gonzalez | 5/37.1 |
| 5,023,966 | A | 6/1991 | Eilersen | |
| 5,394,573 | A * | 3/1995 | Laughlin et al. | 5/18.1 |
| 5,740,564 | A * | 4/1998 | Hankins et al. | 5/12.1 |
| 5,920,928 | A | 7/1999 | Piretti | |
| 5,947,559 | A * | 9/1999 | Williams | 297/337 |
| 6,427,261 | B1 * | 8/2002 | Chadbourn | 5/18.1 |
| 7,171,706 | B2 | 2/2007 | Piretti | |
| 2003/0167566 | A1 | 9/2003 | Inagaki | |
| 2003/0167570 | A1 | 9/2003 | Magistretti | |
| 2008/0092290 | A1 | 4/2008 | Cabrera et al. | |
| 2008/0189851 | A1 * | 8/2008 | Griepentrog | 5/43 |
| 2008/0216230 | A1 | 9/2008 | Yul et al. | |
| 2009/0031494 | A1 | 2/2009 | Pine | |
| 2010/0269255 | A1 * | 10/2010 | Kanthasamy | 5/37.1 |

FOREIGN PATENT DOCUMENTS

| | | |
|---|---|---|
| JP | 10-033311 | 2/1998 |

* cited by examiner

BED TO A SOFA CONVERSION FRAME

CROSS REFERENCE TO RELATED APPLICATIONS

The present application claims the benefit of U.S. Provisional Application No. 61/282,585, filed on Mar. 3, 2010. The entire contents of U.S. Provisional Application No. 61/282,585 are hereby incorporated herein by reference.

FIELD

The present disclosure relates to furniture accessories, and for example, to a sofa conversion frame for converting a bed into a sofa.

DESCRIPTION OF THE RELATED ART

Traditional beds of various different configurations provide a comfortable environment for sleeping. A "traditional bed" refers to a bed comprising a mattress, a box spring and a standard two rail bed frame. However, the size of the traditional bed tends to occupy much of the available space in a room, for example a bedroom, hotel room, studio apartment, leaving little room for other furniture such as a sofa. Several different solutions have been proposed to minimize the required space for a bed or to increase the functional aspects thereof.

One solution involves a conventional sofa bed. This typically comprises a sofa with a foldable internal frame and a foldable mattress that serve as the seat of the sofa. The internal frame and mattress can be unfolded to form a bed. The sofa bed is a space saving piece of furniture, but due to additional hardware and mattress, it is very heavy and unwieldy to move.

Another solution resides in futons. A futon is typically a foldable frame having a foldable mattress. The frame and mattress can be folded into a sofa configuration or unfolded to a bed configuration. This is another sofa/bed combination maximizing living space. However, futons can be daunting to assemble, especially for the foldable frame where the rollers or sliders have to be installed in corresponding grooves.

Due to the above, the present applicant has determined that it would be a benefit in the art of furniture and furniture accessories to provide a space saving and dual functional system with minimal assembly hassles and/or placement thereof.

Additionally, the usage of either a sofa bed or a futon requires the user to purchase and install either article of furniture. Most consumers already have a bed and the present applicant has determined that it would be desirable to provide multiple functionality for the traditional bed, allowing it to be used for additional furniture purposes without having to purchase or otherwise acquire and install additional pieces of furniture.

Thus, the present applicant has determined that a frame that can easily convert a stand-alone traditional bed into a sofa (bed to a sofa conversion frame) may have a benefit by creating a dual purpose for a traditional bed.

SUMMARY

An exemplary embodiment of a "bed to a sofa conversion frame" is a frame separate from a bed/mattress that, when combined with a traditional bed, will allow the traditional bed to function as a sofa. An exemplary embodiment of a frame includes a backrest, a footer (optional) and a pair of armrests adapted to be assembled together to form a sofa frame around a bed.

In an embodiment, the frame allows a traditional bed to be used as both a bed and a sofa, without folding of the mattress.

In an embodiment, the pair of armrests forms a base for connecting the backrest and the footer via connectors, for example, corresponding mounting hardware and mounting slots. Both the backrest and the footer may be, individually, one solid piece, individual pieces connected by connectors, for example, brackets. Both the backrest and the footer may be, individually, detachable and foldable to provide easy breakdown and storage. In an embodiment, the frame may be one unitary piece, or an assembled frame that is not intended to be readily disassembled. For example, an assembled frame that is not intended to be readily disassembled may include a frame where disassembly results in permanent damage to connectors, to the frame or to a covering material. In an embodiment, the footer is not incorporated as a component of the frame. In an embodiment, the armrests can include an extension or an attached bracket to anchor the armrests and backrest to the bed.

These and other features and functions of embodiments of the present disclosure will become readily apparent upon further review of the following specification and drawings.

DETAILED DESCRIPTION OF THE PREFERRED EMBODIMENTS

Figure 1:
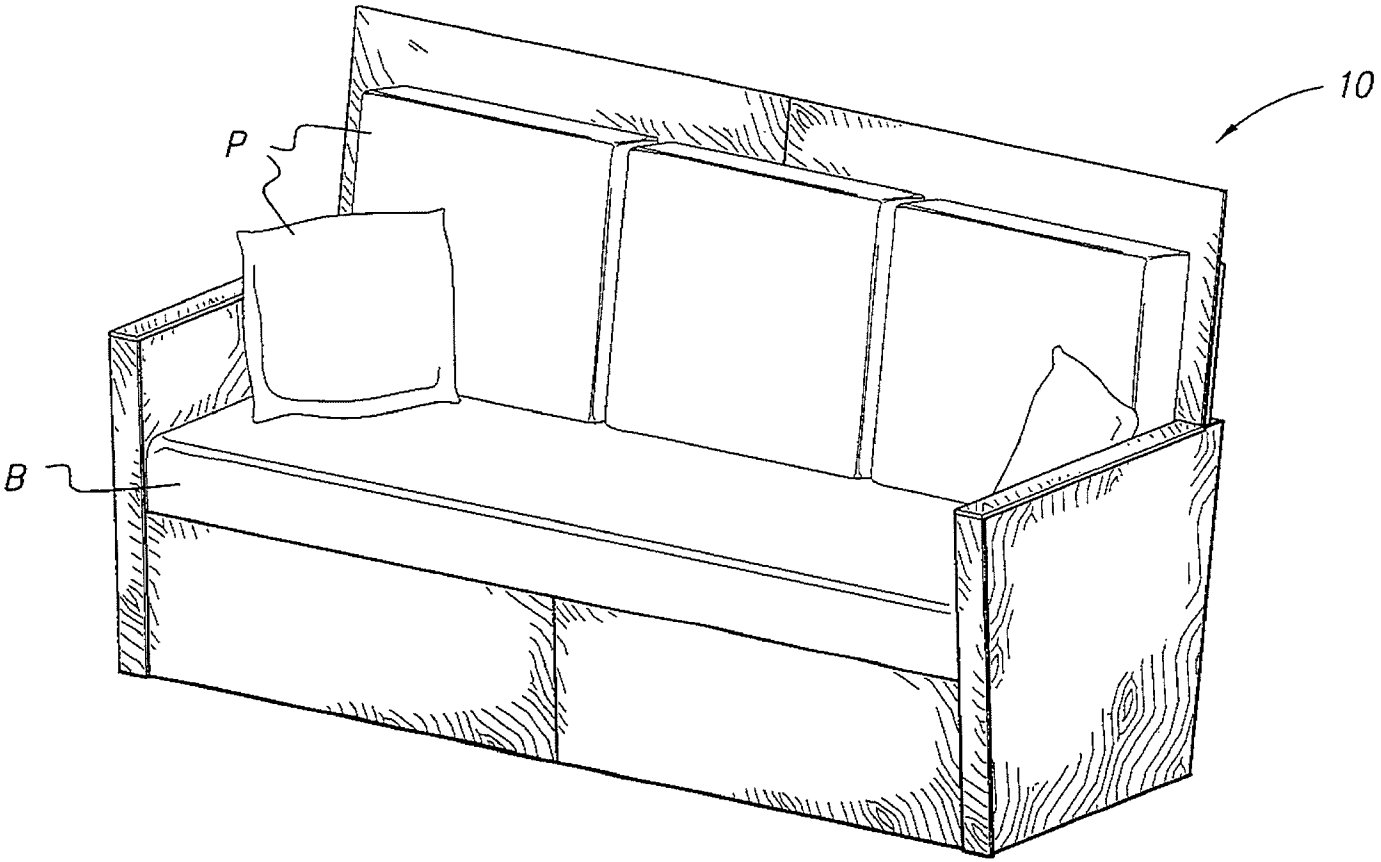
FIG. 1 is an environmental, perspective view of a bed to a sofa conversion frame according to an exemplary embodiment of the present disclosure, the frame being disposed about a bed.

An exemplary embodiment of the present disclosure relates to a bed to a sofa conversion frame, generally referred to in the drawings by reference number 10, for converting a bed into a sofa.

Figure 2:
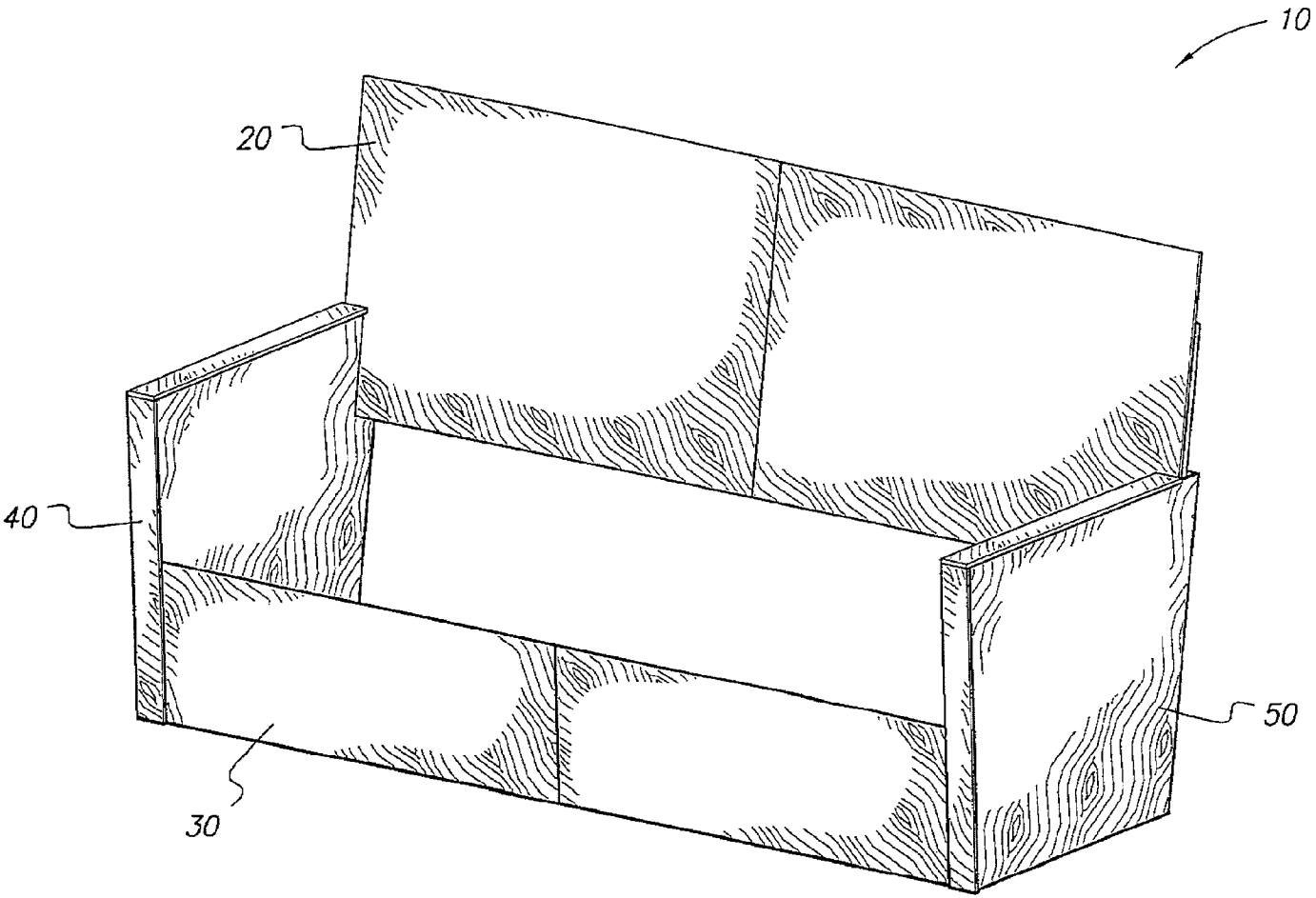
FIG. 2 is a perspective view of the bed to a sofa conversion frame according to an exemplary embodiment of the present disclosure.

As shown in the exemplary embodiments of FIGS. 1 and 2, the bed to a sofa conversion frame 10 includes a backrest 20, a footer 30, a left armrest 40, and a right armrest 50 that surround (also referred to as "wrap around") a bed B when assembled to form the sofa. In an embodiment, the frame is assembled, but the disclosure also contemplates variations where, for example, the frame is a solid one piece frame. The bed B serves as the seating area for the sofa, and with placement of various pillows P, provides a comfortable seating and lounging environment for the user. The bed B may extend behind the frame, for example, under and beyond the backrest 20. In an embodiment, only a portion of the bed's upper surface area is used as a seating area for a sofa. In an embodiment, substantially all the upper surface of the bed is used as a seating area for a sofa.

To show the flexibility of various embodiments of the disclosure, the bed to a sofa conversion frame 10 can be configured for easy assembly, disassembly and storage. As shown in the exemplary embodiments of FIGS. 3A and 3B, both the backrest 20 and the footer 30 are foldable along respective folds 22, 32 via hinges 23, 33. As a result, all the disassembled pieces including the armrests 40, 50 occupy a relatively small amount of space for convenient storage and/or transport. Both the backrest 20 and the footer 30 may include additional folds, or they may include separate panels that can be assembled to form the backrest and the footer. It is also possible to have each be unfoldable and/or of one piece.

Figure 3A:
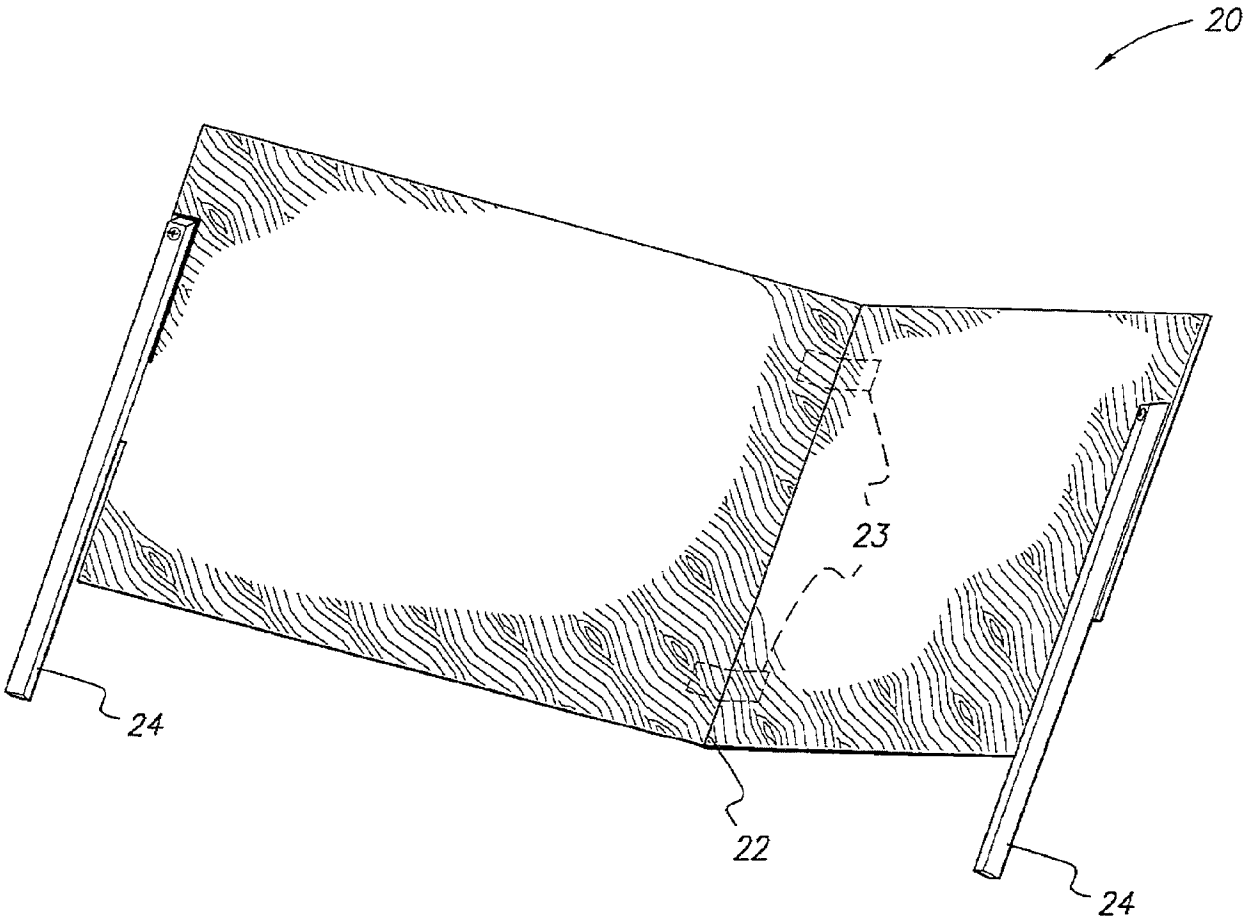
FIG. 3A is a rear perspective view of the backrest for the bed to a sofa conversion frame according to an exemplary embodiment of the present disclosure.

Referring to the exemplary embodiments of FIG. 3A, the backrest 20 includes an elongate, substantially rectangular, panel having a relatively wider dimension than the footer 30 so as to provide enough area to support the user's back. Each opposite end of the backrest 20 can include connectors, for example, mounting hardware for assembly 24, for connecting the backrest 20 to the respective armrests 40, 50. In an exemplary embodiment, the mounting hardware 24 may be foldable to the side in order to, for example, allow the portion of the mounting hardware extending beyond the body of the backrest 20 to be placed against the bottom of the backrest 20 or up to the side of the backrest 20 to allow for easier storage. In an exemplary embodiment, the mounting hardware 24 includes an elongate mounting post attached to the back of the backrest 20 with fasteners. In cases where the frame is one piece, connectors may not be required.

Figure 3B:
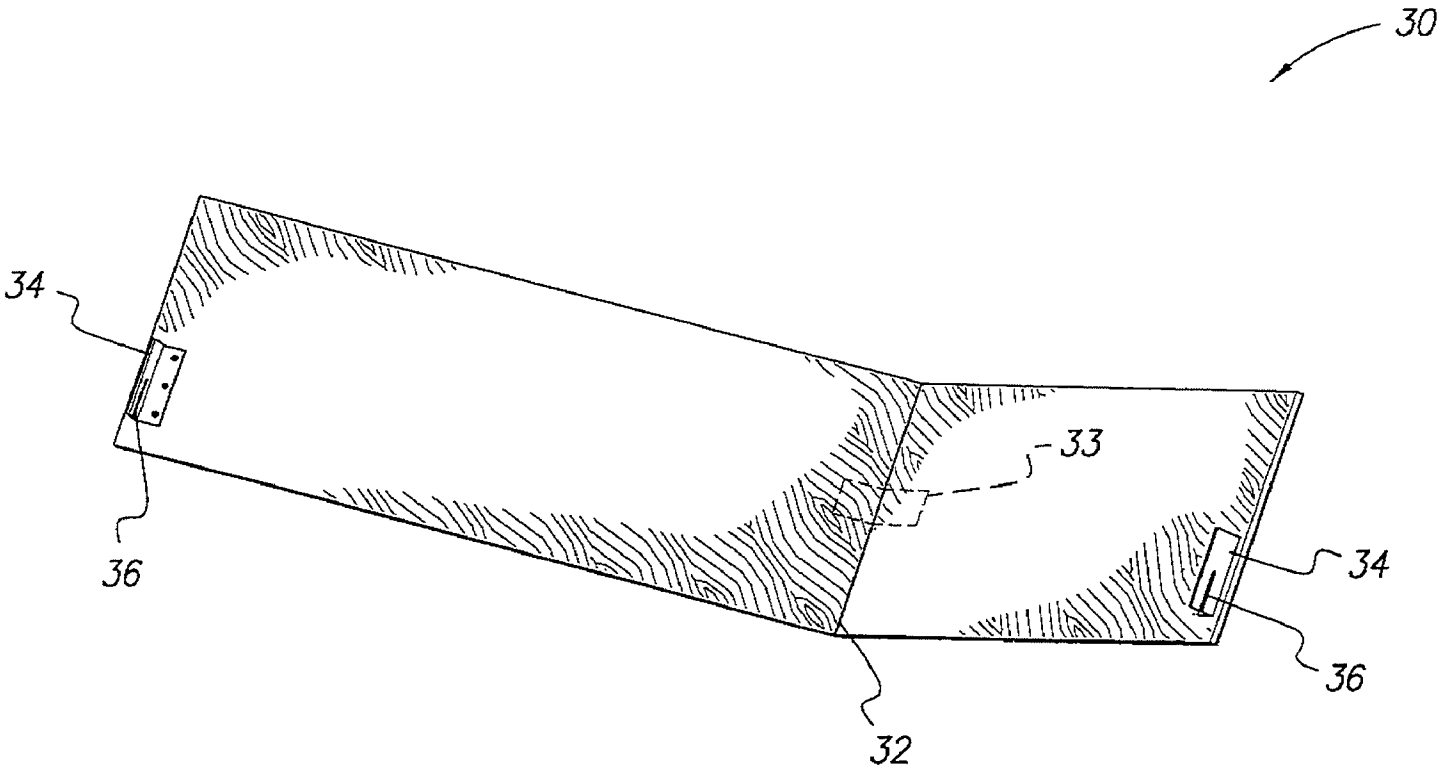
FIG. 3B is a rear perspective view of the footer for the bed to a sofa conversion frame according to an exemplary embodiment of the present disclosure.

Referring to the exemplary embodiments of FIG. 3B, the footer 30 includes an elongate, substantially rectangular, panel, which may be foldable, having a relatively narrower dimension than the backrest 20, since the footer 30 serves, for example, to cover the bottom of the bed B, to connect the armrests 40, 50 together, and as a place for the user's feet to abut. Each opposite end of the footer 30 may include connectors, for example, mounting hardware or assembly 34, for connecting footer 30 to the respective armrests 40, 50. In an exemplary embodiment, the mounting hardware 34 includes a mounting bracket attached to the back of the footer 30 with fasteners. Each mounting bracket may include a mounting slot 36 adapted to mate with a corresponding bracket in the respective armrests 40, 50.

Figure 3C:
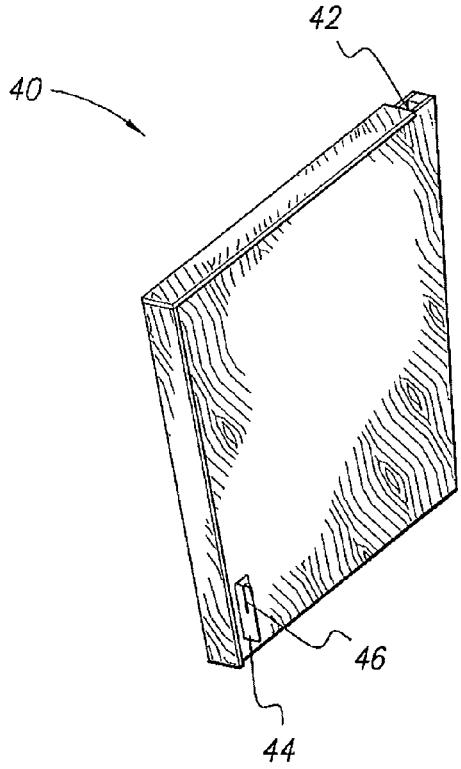
FIG. 3C is a perspective view of the left armrest for the bed to a sofa conversion frame according to an exemplary embodiment of the present disclosure.
Figure 3D:
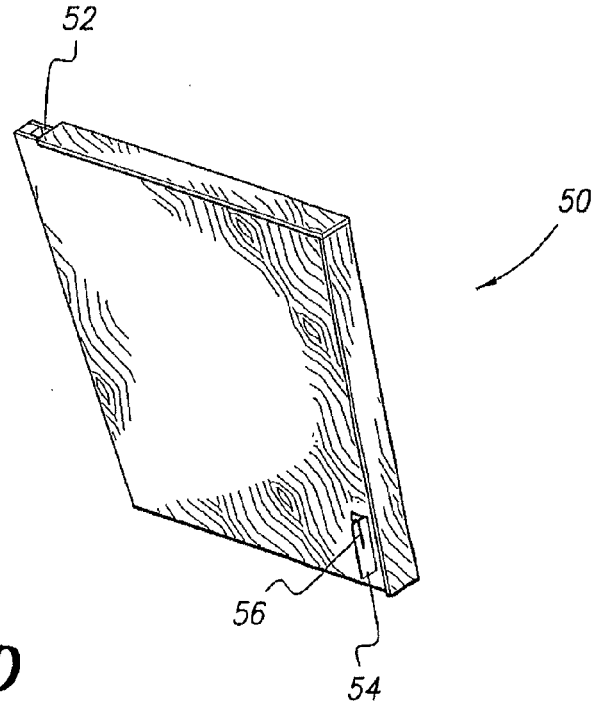
FIG. 3D is a perspective view of the right armrest for the bed to a sofa conversion frame according to an exemplary embodiment of the present disclosure Similar reference characters denote corresponding features consistently throughout the attached drawings.

Referring to the exemplary embodiments of FIGS. 3C and 3D, the left armrest 40 and the right armrest 50 form a base or foundation for the sofa conversion frame 10 allowing the backrest 20 and the footer 30 to be mounted thereon. In an exemplary embodiment, the frame can be manufactured to be one piece (a unit). With particular reference to the exemplary embodiment of FIG. 3C, the left armrest 40 may be a trapezoidal block having a width for comfortably supporting a user's arm. In an embodiment, the rear face of the armrests may be angled (angled meaning at an angle of other than 90° or 180° with respect to the ground). In an embodiment, the armrests may have structure or connectors adapted to allow the backrest to be connected at an angle, wherein the connection angle can be the same or different from the angle of the rear face of the armrests. In an embodiment, the backrest may be angled or curved such that a part of the backrest engaging the armrests may be at a different angle from the top of part of the backrest acting as a back support. In an embodiment, the armrest 40, for example, at or near an angled portion of the armrest 40, may include a connector, for example, a mounting bore, hole or recess 42, adapted to receive a connector of the backrest 20, for example, one of the mounting posts 24 on the backrest 20. In an embodiment, the front, bottom inside portion of the left armrest 40 may include a connector, for example, mounting hardware or bracket 44 with a mounting slot 46, adapted to connect with a connector on the footer 30, for example, with the corresponding mounting bracket 34 and slot 36 on the footer 30. In an embodiment, a connector on the armrest for connecting the armrest to the footer may be placed on any portion of the armrest, for example, on the bottom face, front face or outside face. Since the right armrest 50 may be similarly configured, corresponding similar parts have been referenced with similar numbers (recess 52, bracket 54, and mounting slot 56). The left and right armrests may be mirror-images of each other, or may be formed differently, for example, in shape, design, or type or arrangement of connectors.

In an embodiment, the armrests may act as supports for connecting a backrest, but may not act as armrests, for example, not rising above the height of the upper surface of the bed, for example the upper surface of the mattress. In an embodiment, the height of the armrests may be adjustable in relation to the bed. In an embodiment, the backrest may be connected to the armrests such that the backrest rests on the bed, for example on the mattress. In an embodiment, the backrest may be connected to the armrests in a locked position, such that, for example, the backrest may be positioned to be above the upper surface of the bed, for example the upper surface of the mattress. In an embodiment, the length of the backrest and/or footer may be adjustable to allow the frame to be adapted to various size beds, for example various size mattresses. In an embodiment, the connectors or structure of the armrests and/or backrests may be adjustable to allow, for example, the backrest to recline to various positions. In an embodiment, the connectors or structure of the armrest and/or footer may be adjustable to allow, for example, the footer to move and/or angle up so that the footer acts as a footrest for a seated user In an embodiment, the sofa conversion frame 10 converts an existing bed B into a sofa. In an embodiment, the frame allows for a tool-less configuration for connecting the parts together results in a relatively easy assembly and disassembly while the foldable backrest 20 and footer 30 allows for easy storage with minimal space.

It is to be understood that the sofa conversion frame 10 encompasses a variety of alternatives. For example, the sofa conversion frame 10 may be made from, for example, wood, plastic, steel and/or composites. For example, other types of tool-less or substantially tool-less connecting configurations are alternatives, such as, for example, tongue and groove configurations, locking pins, wing nuts, or presenting the frame as a solid state unit, etc.

Additionally, it should be understood that the sofa conversion frame 10 may be used in combination with any suitable desired accessories or other articles of furniture. For example, backrest 20 may be used in combination with, or include, for example, as a unitary article, a set of drawers, a cabinet or the like, allowing the frame 10 to incorporate storage functionality. It should be understood that any desired storage space or other suitable article of furniture may be incorporated into frame 10 without departing from the spirit or scope of the disclosure.

In an embodiment, the frame is provided without a mattress support structure. In an embodiment, the footer contacts a contacts a front face of the mattress. In an embodiment, the backrest rests upon the mattress. In an embodiment, the bottom of the backrest is positioned above the upper surface of the mattress. In an embodiment, the frame and/or pieces thereof may have curved and/or cushioned surfaces.

In an embodiment, various anchors may be included on the frame to prevent the frame from tipping backwards. For example, the footer may include a component(s) that extends under the front of the bed, for example under the front of the mattress. For example, the armrest(s) may include a component(s) that extend under the side of the bed, for example under the side of the mattress. For example, the footer and/or armrest(s) may include an anchor(s) that presents a high friction surface against the bed, for example against the mattress, to prevent the frame from tipping backwards, when positioned around a bed.

In an embodiment, the frame may be adapted to be placed around a bed via, for example, rolling on wheels or sliding, etc, of the frame. For example, a bed may be in the traditional form of usage as a bed, and converted to a sofa by moving, for example by rolling on wheels or sliding, the pre-assembled or unitary frame around the bed.

In an embodiment, the footer is optional and the frame may be configured without the footer.

In an embodiment, the frame may include, optionally as a unitary article, a storage feature, which includes, for example, set of drawers, shelves, a cabinet or the like, positioned in at least one armrest and/or the backrest, allowing the frame to incorporate storage functionality.

Throughout this disclosure embodiments of a frame have been discussed. The disclosure further contemplates that all embodiments that directed to convert a traditional bed comprising a mattress, box spring, and bed frame into a sofa, are also applicable to convert a bed that may comprise just a mattress, or just a mattress and bed frame, or just a mattress and box spring, and vice versa. Further, the embodiments are also applicable to a bed that also has decorative features, such as a decorative frame.

It is to be understood that the present invention is not limited to the embodiments described above, but encompasses any and all embodiments within the scope of the following claims.

The invention claimed is:

1. A stand-alone frame, the frame being adapted to convert a bed comprising a mattress into a sofa, the frame comprising:

a backrest having backrest connectors at opposite ends thereof; and a pair of armrests forming a base, each armrest having a rear armrest connector adapted to connect to a backrest connector at one end of the backrest;

wherein the backrest and armrests, as a unitary piece or when connected together to form an assembled frame, form a frame adapted for surrounding the bed to convert the bed into a sofa such that at least a portion of an upper surface area of the bed forms a seating area of the sofa, wherein the frame is a stand-alone frame separate from the bed and the frame further comprises a space defined by the backrest and armrests, the space adapted to be filled by the bed.

2. The frame of claim 1, further comprising a footer, the footer having footer connectors at opposite ends thereof, each armrest having a front armrest connector adapted to connect to a footer connector at one end of the footer, wherein, when connected, the space is further defined by the footer.

3. The frame of claim 2, wherein the footer is foldable.

4. The frame of claim 1, wherein the backrest is foldable.

5. The frame of claim 1, wherein the seating area of the sofa is less than the upper surface area of the bed.

6. The frame of claim 5, wherein the frame is adapted to allow a mattress to be used as both a bed and a sofa without folding the mattress.

7. The frame of claim 1, wherein each armrest has a rear face that is angled.

8. The frame of claim 1, wherein the frame is adapted to allow the backrest to be connected at an angle.

9. The frame of claim 1, wherein the backrest is angled such that a part of the backrest engaging the armrests is at a different angle from a top part of the backrest acting as a back support.

10. The frame of claim 1, wherein the armrests rise to a height above the upper surface of the bed.

11. The frame of claim 1, wherein the armrests rise to a height below the height of the upper surface of the bed.

12. The frame of claim 1, wherein the height of the armrests is adjustable.

13. The frame of claim 1, wherein the length of the backrest is adjustable.

14. The frame of claim 1, the frame further comprising anchors adapted to extend under the bed to prevent the frame from tipping backwards.

15. The frame of claim 1, wherein the connectors are adapted to allow for at least a substantially tool-less connection of the backrest and armrests to assemble the frame.

16. The frame of claim 1, wherein the bed further comprises a box spring and a standard two rail bed frame.

17. The frame of claim 1, wherein the frame is adapted such that the bed extends beyond the backrest so that only a portion of the bed's upper surface forms a seating area for the sofa.

18. The frame of claim 1, wherein the backrest has an uppermost and a lowermost vertical extent, the lowermost vertical extent being at or above the upper surface area of the bed which forms the seating area of the sofa.

* * * * *